US005751239A

United States Patent [19]

Wichmann

[11] Patent Number: 5,751,239

[45] Date of Patent: May 12, 1998

[54] DISTANCE SENSOR FOR PROJECTILE FUZES

[75] Inventor: Gunter Wichmann, Leiman, Germany

[73] Assignee: Eltro GmbH, Heidelberg, Germany

[21] Appl. No.: 640,147

[22] Filed: May 10, 1984

Related U.S. Application Data

[63] Continuation-in-part of Ser. No. 587,316, Mar. 7, 1984, Pat. No. 4,613,231.

[30] Foreign Application Priority Data

May 9, 1983 [DE] Germany ..... 32 15 845.9

[51] Int. Cl.[6] ..... F42C 13/04

[52] U.S. Cl. ..... 342/68

[58] Field of Search ..... 342/68

[56] References Cited

U.S. PATENT DOCUMENTS 4,072,944 2/1978 Bianco et al. ..... 342/68 X
4,354,192 10/1982 Kohler ..... 342/68 X
4,360,812 11/1982 Peperone ..... 342/68 X

*Primary Examiner*—Michael J. Carone
*Attorney, Agent, or Firm*—Handal & Morofsky

[57] ABSTRACT

The distance sensor for projectile fuzes, according to the invention, employs a range finder (6', 17, 25, 27) operating on the principle of pulse propagation time. The signal (18) is radiated by an antenna (4, 5') and the portion (18') reflected by the target is also received thereby. From a pulse (17') derived from the transmitter pulse and delayed in time by a definite amount in the delay member (19), one obtains the receiver sampling pulse (20). This pulse is used to sample the portion (18') and the resulting low-frequency representation of the receiver pulse is passed through a low-frequency amplifier (21) and a band-pass filter (44). If the frequency components of the transmitter pulse (18) are made as low as possible and the signal portions (18') reflected at the target are received only from a narrowly limited range of distances, then this method makes it possible to distinguish metal targets from non-metal targets as well as to distinguish targets of a given size from smaller targets with the aid of a simple amplitude threshold device (FIG. 1).

4 Claims, 2 Drawing Sheets

DISTANCE SENSOR FOR PROJECTILE FUZES

CROSS-REFERENCE TO RELATED APPLICATION

This application is a continuation-in-part of U.S. patent application Ser. No. 587,316 of Wichmann entitled "Laser Range Finder with Non-Linearity Compensation" filed Mar. 7, 1984, U.S. Pat. No. 4,613,231.

TECHNICAL FIELD

The invention relates to a distance sensor for projectile fuzes, operating in accordance with the sampling principle and being particularly well adapted to jamming-insensitive configurations.

BACKGROUND ART

Magnetic, capacitive and alternating field distance sensors are known for detecting metallic targets. Aside from the relatively low effective range of only a few meters, these types of sensors cannot distinguish within their effective range whether they are seeing an object that is already very close and is of small dimensions or one that is still far away but has correspondingly larger dimensions.

It is the basic task of the invention to so improve upon such sensors to be able, especially with a view to attacking helicopters, to reliably distinguish metal targets from non-metal targets and also sufficiently large targets from smaller targets that are out of consideration, even at distances of several tens of meters.

DISCLOSURE OF INVENTION

The frequency content of the transmitted electromagnetic pulse is kept intentionally low for reasons of signal processing. However consideration must also be given to the size of the target that would no longer reflect a signal having too low a frequency. Hence, the frequency content must be a balanced compromise between the reflection properties of metals and non-metals and the size of the target.

Aspects of the inventive system, as described below result in particular advantageous operational characteristics. Due to the relatively small diameter of the projectiles and the small antennae used to send pulses, the transmitted and reflected pulses are radiated with nearly spherical geometries resulting in very low received and reflected energies. Consequently, it is advantageous firstly that the method according to the invention can integrate several thousand transmitted pulses, thus increasing the receiver sensitivity as a function of the square root of the number of transmitted pulses. Even though the radiation characteristics of the antenna are nearly spherical, it is possible also to achieve a certain amount of effective directionality of the sensor in that the resultant low-frequency signal is passed through a band-pass filter. As the frequency of the low-frequency signal is also a function of the relative velocity between the sensor and the target (the Doppler effect), signals due to objects located to the side of the projectile (ground targets), are also suppressed i the band-pass filter for having insufficient relative velocity and, accordingly, different frequency content.

Additionally, the method according to the invention is inherently insensitive to jamming transmitters of any kind because a basic condition for generating the low-frequency signal is the presence of a signal which is synchronous with the receiver sampling pulse. Such a state can occur only by coincidence and, in order to eliminate even such coincidences, it is possible to strongly randomly modulate the transmitter and receiver sampling pulses so that any synchronism between a jamming transmitter and the sensor's own pulses is impossible. Another possibility to exclude continuous wave jammers is given in that a second receiver channel is supplied with a signal delayed by $\lambda/2$. One then obtains a second output signal which is shifted relative to the first one by 180°, so that both signals are extinguished in addition. The local signal is not suppressed, however, but is generated twice in shirt succession with opposite polarities.

A further aspect of the invention provides that a second (laser) rangefinder for detecting target distance and directional characteristics is combined with the first range finder which detects dimensions and material.

BRIEF DESCRIPTION OF DRAWINGS

One way of carrying out the invention is described in detail below with reference to drawings which illustrate only one specific embodiment (corresponding parts in the individual figures carrying the same reference characters), in which.

BEST MODE FOR CARRYING OUT THE INVENTION

Figure 1:
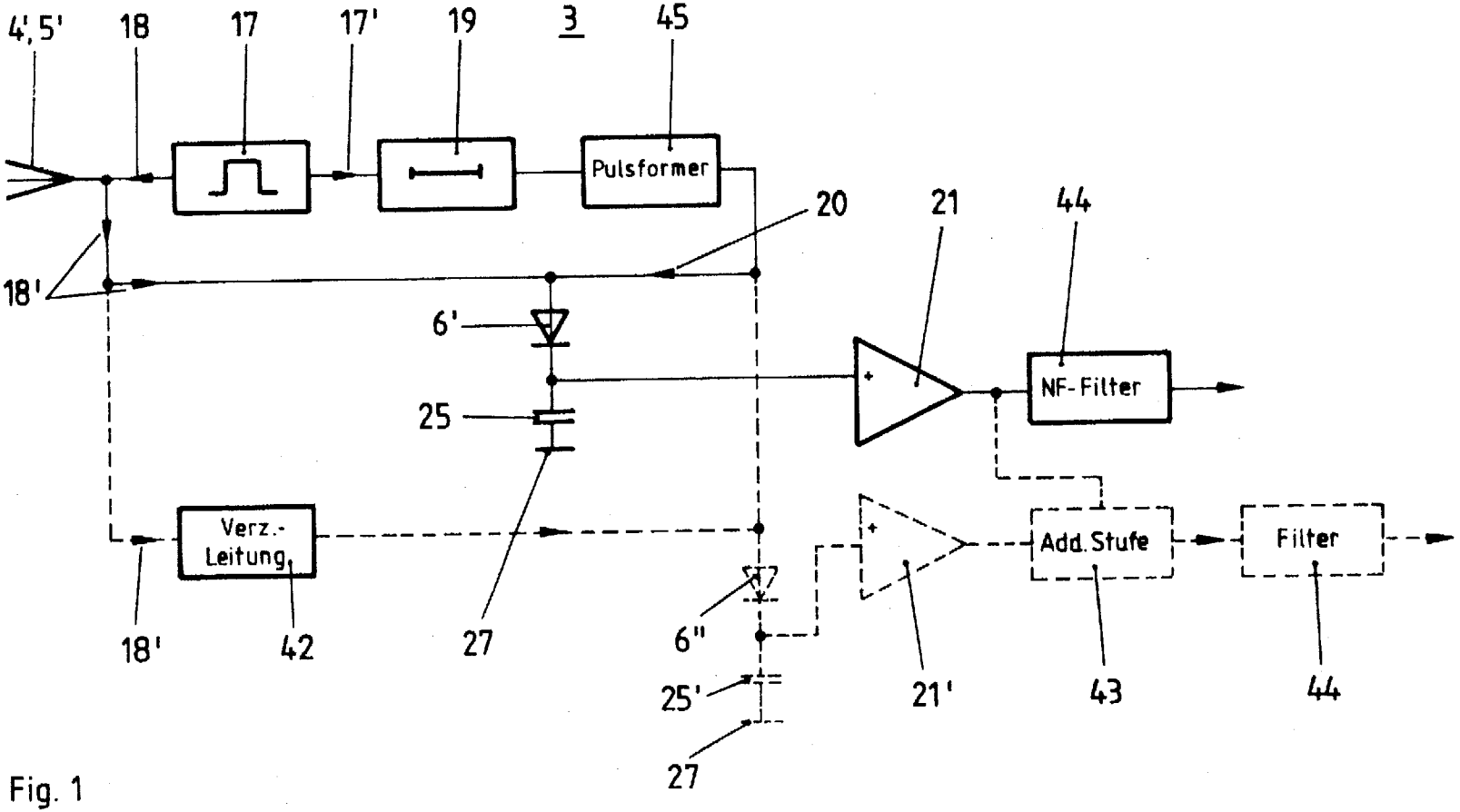
FIG. 1 is a block diagram and a sketch showing the principle of the range sensor according to the invention.
Figure 2:
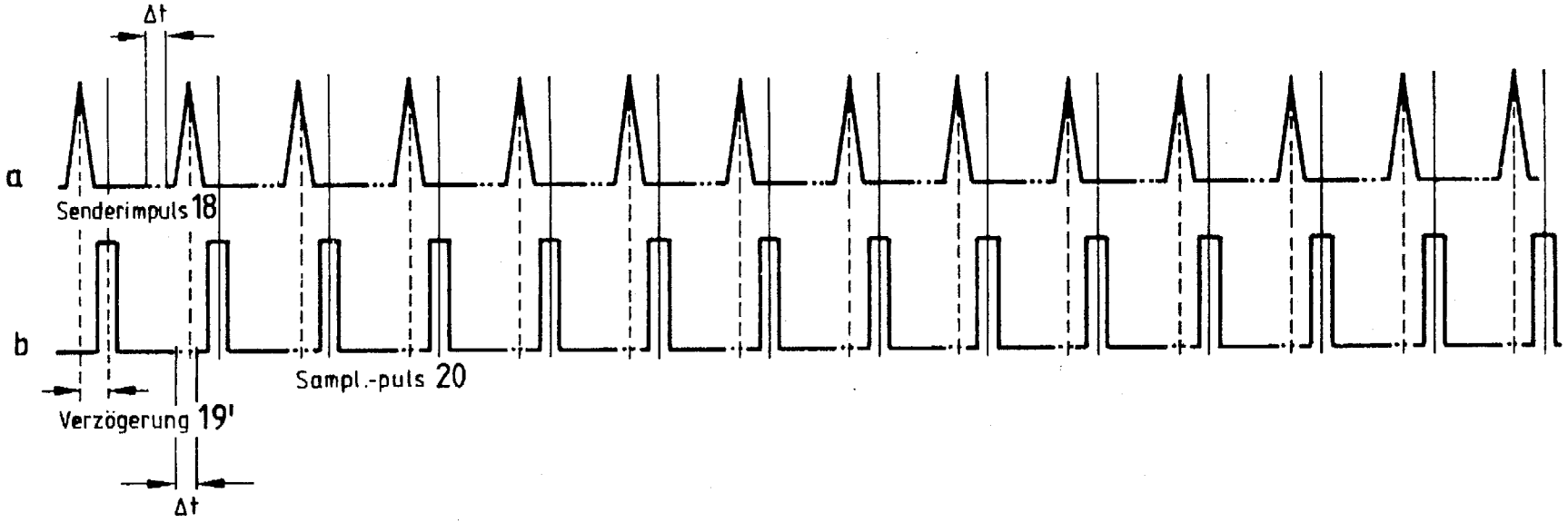
FIG. 2 is a pulse diagram of the transmitter and spike pulses of the sensor of FIG. 1 with noise modulation $\Delta t$ illustrated by waveform b.

For sensing a definite distance to a target, FIG. 1 illustrates the inventive system. A pulse generator 17 generates a signal which is transmitted by a transmitting and receiving antenna array 4', 5' in the form of pulses 18 as shown in FIG. 2 (waveform a) and sent toward a target at high frequency. Portions 18' reflected by the target are received by the same antenna. A small part 17' of the pulse-shaped driver voltage is coupled out and is used as a receiver sampling pulse after passing through a delay line 19 and the pulse shaper 45. The delay time 19' in FIG. 2 (waveform b) is so adjusted that it corresponds to the length of the path of the transmitter pulse from the antenna 4', 5' to the target and back at the particular distance which one desires to detect. At this distance, typically on the order of 1–2 km, only a large metal object will have the reflectivity to produce a reflected pulse strong enough to trigger a threshold device as will be described below. Such a threshold device would also be incorporated in, for example, amplifier 21 or 21'.

If the sensor 3 is flying toward the target, no signal is received initially because it cannot coincide with the receiver sampling pulse 20. However, if the target is approaching, the signal portions 18' reflected thereby move farther into the receiver sampling pulse 20 with each cycle and are sampled by that pulse via the sampling diode 6'. Connected in series with that diode is the charging capacitor 25 whose other end is grounded at the point 27; on it appears a low-frequency voltage that is an exact low-frequency representation of the high-frequency pulse and frequency content of which is also a measure of the approach speed. This low-frequency signal is then passed to the low-frequency amplifier 21 connected between the sampling diode 6' and the charging capacitor 25. The operation of the inventive system, as respects the above discussion, is explained in greater detail in the above-identified parent application, which, like the present application, involves a sampling principle receiver system.

What is significant in the present invention is the special use being made of the sensor and that it is intended that it should serve especially to detect metallic targets of a given order of dimension, and, in particular, helicopters. In so doing, one exploits the physical fact that metallic objects of sufficient size will almost completely reflect any electromagnetic wave regardless of frequency, whereas the reflection of non-metallic objects decreases for decreasing frequency and is lower for lower ratios of material thickness to wavelength.

Even though a helicopter is a metal target that reflects all electromagnetic waves, the size of the helicopter is such that the frequency of the signal cannot be chosen to be arbitrarily low because such a signal would pass around the helicopter instead of being reflected by it; in a typical application, the frequency might lie approximately between 50 and 100 MHz. At that frequency, the difference between the reflective properties of metals and non-metals is not yet sufficiently great so that care must be taken to insure that the sensor sees only signals coming from definite distance. The reflection from a plastic object at a very short distance could easily be just as great as the reflection from a metal object at a very large distance.

This type of sensor is intended for flying craft (projectiles, rockets) having a relatively small diameter of approximately 12 to 15 cm and a range of approximately 15 km. Therefore, the antenna 4', 5' has only a very poor efficiency factor for radiating the low-frequency pulses adapted to the target which would lead to problems of sensitivity. That is compensated, however, by the fact that many thousands of received pulses are integrated in accordance with the sampling principle.

The low-frequency signal can be passed through a band-pass filter 44 connected to the output of the low-frequency amplifier 21 so that, in this way, signals reflected from objects whose relative velocity with respect to the flying craft is low (ground targets) can be suppressed.

The broken-line connections shown in FIG. 1 are not necessary but represent a refinement which makes the inventive system resistant to jamming transmitters. It consists of providing that the received signal 18 is delayed in the delay member 42 which delays signal 18 by half a wavelength for the wavelength of the receiver system and then passed to a second receiver system. The latter again comprises a sampling diode 6", a charging capacitor 25' connected in series therewith and having its other electrode connected to ground at point 27 and a low-frequency amplifier 21' branched off between the diode and the capacitor. In this case, the output of the amplifier 21 is joined to the output of the amplifier 21' in the summing stage 43 whose own output is connected to the band-pass filter 44.

Another exemplary embodiment, not shown in the drawing, provides that the transmitted pulses and the receiver sampling pulses are noise-modulated with a modulation $\Delta t$ so that signals coming from jamming transmitters can no longer be synchronous with the receiver sampling pulse 18' which would be a condition for their being received. It will be understood that the delay time between a given transmitter pulse and the associated receiver sampling pulse must not be affected by the noise modulation $\Delta t$. (FIG. 2).

In practice, such a "metal sensor" is usually combined with a proximity fuze, ideally a laser range finder, to permit improved definition of the field of view and, if necessary, to carry out a more precise measurement of the distance to the target. The former will be so designed that, just prior to the time when the additional sensor triggers, it provides information as to whether the target is metallic or not, while the other range finder makes a more precise measurement of the distance and determines the directional characteristics. It is noted that, in practice, an amplitude threshold device may be used to selectively produce an output at filter 44 only in response to the strong reflected signals that indicate a large metal object such as a helicopter.

Of course, the principle of the present invention can also be employed to detect metallic targets other than helicopters, provided the frequency content of the pulses is suitably changed, and this may be cone without leaving the frame of the invention.

I claim:

1. A distance sensor for projectile fuzes incorporating a first range finder operating on the sampling principle, comprising, means for transmitting a pulse signal, a first receiver system comprising means for generating a sampling signal in the form of pulses which are delayed a fixed period of time with respect to said transmitted pulse signal, gate means for receiving a transmitted pulse which has been reflected from a target and passing a sample portion of the reflected pulse in response to the coincidence of said sample portion with said sampling signal, integrator means for integrating said passed samples to form a low-frequency representation of said reflected pulse, and threshold means responsive to said low-frequency representation to produce an output only in response to said low frequency representation surpassing a predetermined threshold value.

2. A distance sensor according to claim 1 wherein that low-frequency representation produced from the receiver signal is coupled to a band-pass filter.

3. A distance sensor for projectile fuzes incorporating a first range finder operating on the sampling principle, comprising, means for transmitting a pulse signal, a first receiver system comprising means for generating a sampling signal in the form of pulses which are delayed a fixed period of time with respect to said transmitted pulse signal, gate means for receiving a transmitted pulse which has been reflected from a target and passing a sample portion of the reflected pulse in response to the coincidence of said sample portion with said sampling signal, integrator means for integrating said passed samples to form a low-frequency representation of said reflected pulse, and threshold means responsive to said low-frequency representation to produce an output only in response to said low frequency representation surpassing a predetermined threshold value, and further comprising a delay member, a second receiver system and a summing stage, and wherein any received jamming signal is passed together with said reflected pulses through said delay member, said delay member having a delay which delays said received signals by $\lambda/2$, and supplied to said second receiver system, said second system operating in accordance with the sampling principle, the output of both receiver systems being connected to said summing stage, the output of said summing stage being connected to the band-pass filter.

4. A distance sensing method for projectile fuzes for use in connection with a first range finder operating on the sampling principle, comprising the steps of, transmitting a pulse signal, generating a sampling signal in the form of pulses which are delayed a fixed period of time with respect to said transmitted pulse signal, receiving a transmitted pulse which has been reflected from a target and passing a sample portion of the reflected pulse in response to the coincidence of said sample portion with said sampling signal, integrating said passed samples to form a low-frequency representation of said reflected pulse and responding to said low-frequency representation to produce an output only in response to said low frequency representation surpassing a predetermined threshold value, the transmitter pulse being generated with energy components which peak at a frequency having a wavelength of the same order of magnitude as the target to be detected.

* * * * *